US007394891B2

(12) United States Patent
Sakabe

(10) Patent No.: US 7,394,891 B2
(45) Date of Patent: Jul. 1, 2008

(54) X-RAY GENERATING METHOD AND X-RAY GENERATING APPARATUS

(75) Inventor: Noriyoshi Sakabe, Tsukuba (JP)

(73) Assignee: Noriyoshi Sakabe and Kiwake Sakabe, Tsukuba (JP)

( * ) Notice: Subject to any disclaimer, the term of this patent is extended or adjusted under 35 U.S.C. 154(b) by 46 days.

(21) Appl. No.: 11/509,670

(22) Filed: Aug. 25, 2006

(65) Prior Publication Data

US 2007/0104319 A1 May 10, 2007

(30) Foreign Application Priority Data

Sep. 14, 2005 (JP) ..... 2005-267227

(51) Int. Cl.
*H01J 35/00* (2006.01)

(52) U.S. Cl. ..... 378/126; 378/127

(58) Field of Classification Search ..... 378/119, 378/121–140, 144

See application file for complete search history.

(56) References Cited

U.S. PATENT DOCUMENTS 3,836,805 A * 9/1974 Kok ..... 378/126
4,675,891 A 6/1987 Plessis et al.
6,341,157 B1 1/2002 Sakabe

FOREIGN PATENT DOCUMENTS

| | | |
|---|---|---|
| JP | A 04-010342 | 1/1992 |
| JP | 11-339704 | 12/1999 |
| WO | WO 2004/023852 A2 | 3/2004 |
| WO | WO 2005/008716 A2 | 1/2005 |

* cited by examiner

*Primary Examiner*—Jurie Yun
(74) *Attorney, Agent, or Firm*—Oliff & Berridge, PLC

(57) ABSTRACT

An anticathode is repeatedly moved along a rotating axis of the anticathode while the anticathode is rotated around the rotating axis. Then, energy beams are irradiated onto a surface portion of the anticathode which is located against a centrifugal force generated from the rotation of the anticathode to partially melt the surface portion through the heating said surface portion near the melting point of the anticathode or over the melting point of the anticathode, thereby generating an X-ray from the rotating anticathode.

30 Claims, 4 Drawing Sheets

X-RAY GENERATING METHOD AND X-RAY GENERATING APPARATUS

FIELD OF THE INVENTION

This invention relates to an X-ray generating method and an X-ray generating apparatus for generating an X-ray with ultrahigh brightness.

DESCRIPTION OF THE BACKGROUND ART

In X-ray diffraction measurement, it may be required to irradiate an X-ray with as high intensity as possible onto a sample. In this case, a conventional rotating anticathode type X-ray generating apparatus would be employed for the X-ray diffraction measurement.

The rotating anticathode type X-ray generating apparatus is configured such that electron beams are irradiated onto the outer surface of the columnar anticathode (target) in which a cooling medium is flowed while the anticathode is rotated at high speed. In comparison with a stationary target type X-ray generating apparatus, the rotating anticathode type X-ray generating apparatus can exhibit extreme cooling efficiency because the irradiating position of the electron beams on the anticathode changes with time. Therefore, in the rotating anticathode type X-ray generating apparatus, the electron beams can be irradiated onto the anticathode in large electric current, thereby generating an X-ray with high intensity.

By the way, since the intensity of the resultant X-ray generated is in proportion to the electric power (current x voltage) to be applied between the cathode and the anticathode, the intensity of the X-ray can be enhanced only to 1.2 kW at a maximum in the conventional rotating anticathode type X-ray generating apparatus when the electron beams are irradiated onto the target at a spot size of 0.1×1 mm, and also only to 3.5 kW at a maximum in an ultrahigh brightness rotating anticathode type X-ray generating apparatus.

In this point of view, such a technique is disclosed in Japanese Patent Laid-open Application No. 11-339704 as heating the anticathode near the melting point thereof with the electron beams and thus, partially melting the electron beam irradiating portion of the anticathode, thereby generating an X-ray with high intensity. With such a technique, however, the X-ray may not be generated stably over a long period of time on the irradiating condition of the electron beams, so that it is required to improve the performance of the conventional X-ray generating apparatus.

[Patent Document No. 1] Japanese Patent Laid-open Application No. 11-339704

SUMMERY OF THE INVENTION

It is an object of the present invention to provide an X-ray generating method and an X-ray generating apparatus which can generate an X-ray with high intensity stably over a long period of time.

Means for Solving the Problem

In order to achieve the object, this invention relates to a method for generating an X-ray, comprising the steps of: moving an anticathode repeatedly along a rotating axis of the anticathode while rotating the anticathode around the rotating axis; and irradiating energy beams onto a surface portion of the anticathode which is located against a centrifugal force generated from the rotation of the anticathode to partially melt the surface portion through the heating the surface portion near the melting point of the anticathode or over the melting point of the anticathode, thereby generating an X-ray from the rotating anticathode.

Also, this invention relates to an apparatus for generating an X-ray, comprising: a rotating anticathode configured so as to be rotated around a rotating axis thereof and to be moved repeatedly along the rotating axis; and an energy source for irradiating energy beams onto a surface portion of the anticathode which is located against a centrifugal force generated from the rotation of the anticathode to partially melt the surface portion through the heating the surface portion near the melting point of the anticathode or over the melting point of the anticathode, thereby generating an X-ray from the rotating anticathode.

The inventor intensely researched the cause that the intended X-ray with high intensity can not be generated stably over a long period of time when the rotating anticathode is heated near the melting point with the electron beams so as to partially melt the electron beam irradiating portion of the anticathode as described in Japanese Patent Laid-open Application No. 11-339704.

As a result, the inventor found out that when the rotating anticathode is heated near the melting point thereof with the electron beams so as to generate an intended X-ray with high intensity, the electron beam irradiating portion becomes depressed so that the X-ray generated from the electron beam irradiating portion is absorbed at the side walls of the depressed portion of the electron beam irradiating portion.

In this point of view, the inventor made such an attempt as not forming the depressed portion of the electron beam irradiating portion of the rotating anticathode even though energy beams such as electron beams with high intensity are irradiated. As a result, the inventor found out that if the rotating anticathode is moved repeatedly along the rotating axis thereof while the rotating anticathode is rotated around the rotating axis, the depth of the depressed portion of the energy beam irradiating portion can be reduced even though the energy beams with high intensity are irradiated onto the anticathode.

Therefore, even though the energy beams with high intensity are irradiated, the resultant X-ray can not be almost absorbed at the side wall so that the intended X-ray with high brightness can be generated stably over a long period of time.

In a preferred embodiment of the present invention, the movement of the rotating anticathode along the rotating axis is carried out periodically. In this case, the energy beam irradiating portion of the rotating anticathode can be enlarged and the depressed portion of the rotating anticathode is formed in a trapezoidal shape so that the intended X-ray with high intensity can be generated stably over a long period of time.

In another preferred embodiment of the present invention, the moving length of the rotating anticathode along the rotating axis may be determined on the line width of the energy beams. Concretely, the moving length of the rotating anticathode can be preferably set larger than the line width of the energy beams. In this case, the depth of the depressed portion of the energy beam irradiating portion can be much reduced.

In still another preferred embodiment of the present invention, the moving length of the rotating anticathode along the rotating axis is set at least twice as large as the line width of the energy beams. In this case, the depth of the depressed portion of the energy beam irradiating portion can be much reduced so that the reduction in intensity of the intended X-ray can be set only to 5% or below. Therefore, the intended X-ray can be generated at an efficiency of 95% or more over a long period of time.

As described above, according to the present invention can be provided an X-ray generating method and an X-ray generating apparatus which can generate an X-ray with high intensity stably over a long period of time.

BRIEF DESCRIPTION OF THE DRAWINGS

For better understanding of the present invention, reference is made to the attached drawings, wherein.

DESCRIPTION OF THE PREFERRED EMBODIMENTS

This invention will be described in detail with reference to the accompanying drawings.

Figure 1:
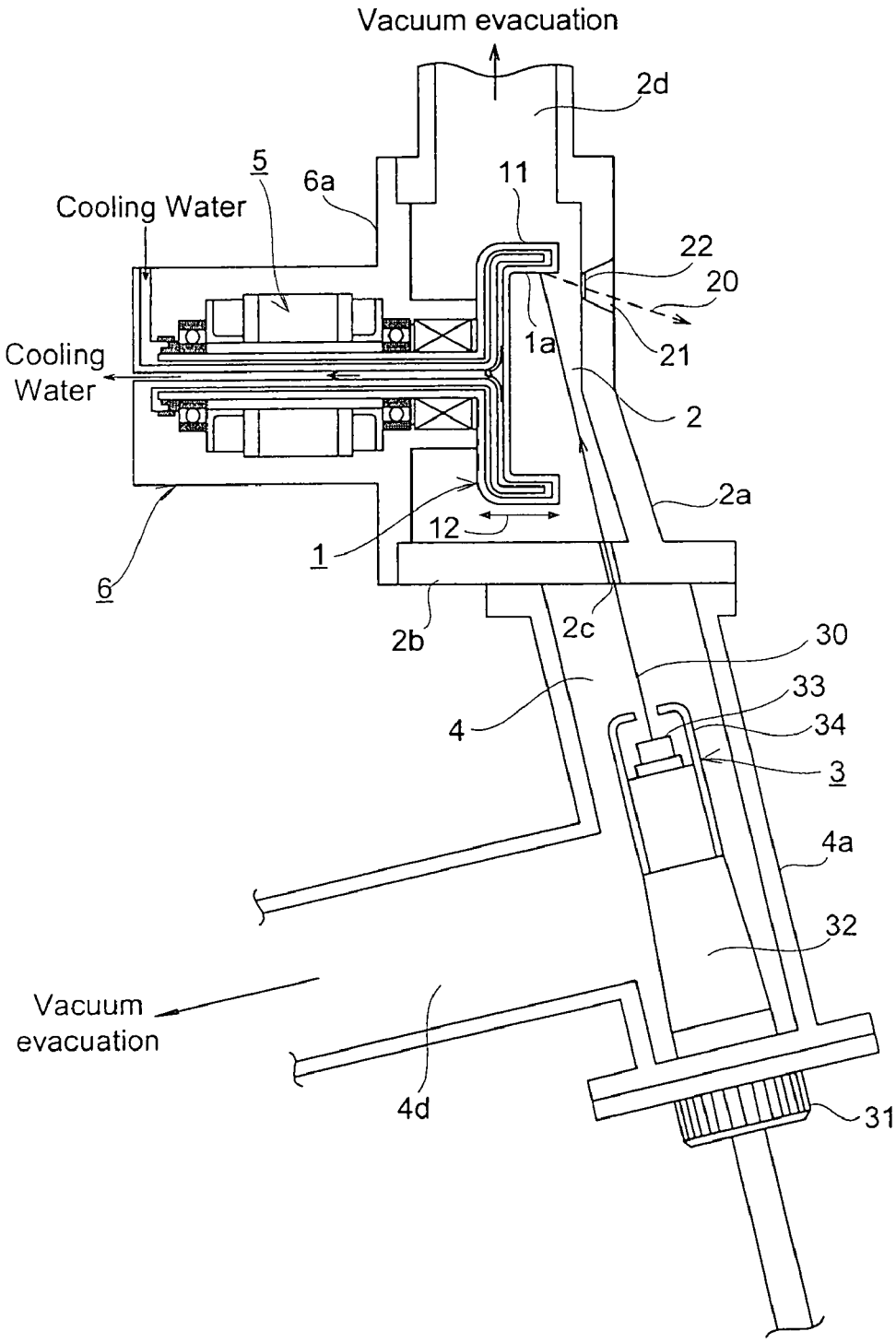
FIG. 1 is a cross sectional view illustrating an X-ray generating apparatus according to the present invention.
Figure 2:
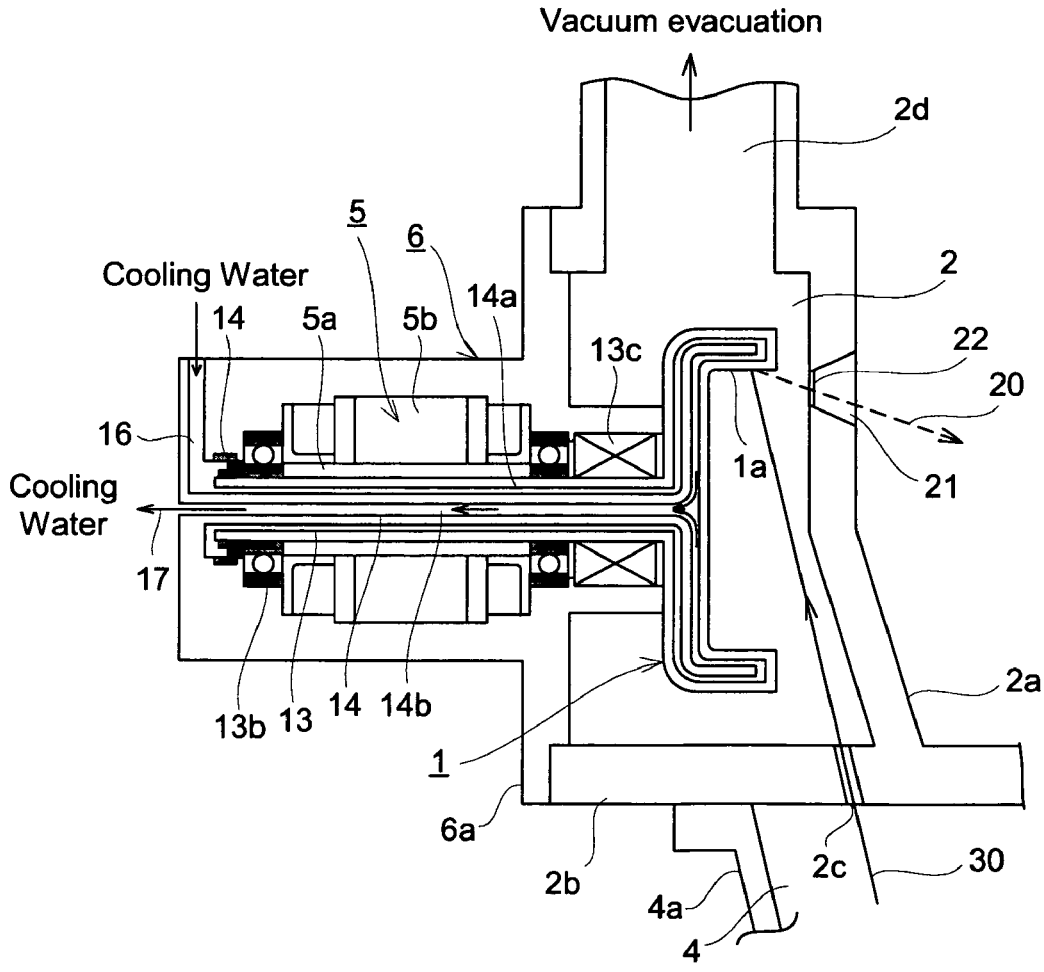
FIG. 2 is an enlarged cross sectional view illustrating a part of the X-ray generating apparatus illustrated in FIG. 1.

FIG. 1 is a cross sectional view illustrating an X-ray generating apparatus according to the present invention, and FIG. 2 is an enlarged cross sectional view illustrating a part of the X-ray generating apparatus illustrated in FIG. 1.

The X-ray generating apparatus includes an anticathode chamber 2 for accommodating a rotating anticathode 1, a cathode chamber 4 for accommodating a cathode 3 and a rotation driving chamber 6 for accommodating a driving motor 5 for rotating the anticathode 1 which are located in the vicinity of one another and separated from one another by air-tight members 2*a*, 4*a* and 6*a*. At a separating wall 2*b* for separating the anticathode chamber 2 and the cathode chamber 4 is formed a small hole 2*c* for passing electron beams 30 to be emitted from the cathode 3 through the separating wall 2*b*. Then, at the anticathode chamber 2 and the cathode chamber 4 are provided vacuum outlets 2*d* and 4*d*, respectively to which vacuum pumps (not shown) are connected.

Particularly, not illustrated in the figures, in the rotation driving chamber 6, the driving motor 5 includes a rotating motor for rotating the rotating anticathode around the rotating axis and a vertically moving motor for moving the rotating anticathode repeatedly along the rotating axis, as shown by arrow 12. The rotating motor is configured such that the rotating anticathode 1 can be rotated at a speed within a range of several thousands-ten thousands times/minute. The vertically moving motor is configured such that the rotating anticathode 1 can be moved repeatedly and vertically at a speed within a range of 0.01-1 time/minute.

The rotating anticathode 1 includes a cylindrical portion 11 made of Cu or the like, a circular plate 12 formed so as to close the one opening of the cylindrical portion 11, and a rotating shaft 13 with a center shaft shared with the cylindrical portion 11 and the circular plate 12 which are integrally formed. The interiors of the cylindrical portion 11, the circular plate 12 and the rotating shaft 13 are formed in air hole so that a cooling water can be flowed in the interiors thereof. The electron beams are irradiated onto the inner wall of the cylindrical portion 11. In this case, the resultant electron beam irradiating portion can exist against the centrifugal force from the rotating movement of the rotating anticathode with the motor.

The rotating shaft 13 is supported rotatably by a pair of bearings 13*a* and 13*b* which are provided in the rotation driving chamber 6.

At the root of the rotating shaft 13 near the circular plate 12 is provided a rotating shaft-sealing member 13*c* for maintaining the interior of the anticathode chamber 2 in vacuum by arranging the rotating shaft 13 and the air-tight member 6*a* under air-tight condition.

In the rotating anticathode 1 is inserted a stationary separating member 15 for flowing the cooling water along the inner wall of the electron beam irradiating portion 11*a*. The stationary separating member 15 is formed in a cylindrical shape, enlarged along the shape of the circular shape 12 and elongated short of the inner wall of the cylindrical portion 11.

In other words, the stationary separating member 15 divides the interior space of the rotating anticathode 1 so as to be a double tube structure. The outer tube 14*a* of the double tube structure is communicated with a cooling water inlet 16. Herein, an axial sealing member 14 is provided at the left-side periphery of the rotating shaft 13 so that the cooling water, which is introduced from the inlet 16, is introduced into the outer tube 14*a* of the double tube structure so as not to be leaked to the accommodating space where the bearings 13*a*, 13*b* and the driving motor 5 are provided.

The cooling water, which is introduced from the inlet 16, is flowed in the outer tube 14*a* of the double tube structure, returned from the inner wall of the cylindrical portion 11 and flowed in the inner tube 14*b* of the double tube structure. In this case, the inner wall of the electron beam irradiating portion 11*a* is cooled by the cooling water, and the remnant cooling water is flowed in the inner tube 14*b* and discharged from the outlet 17.

At the air-tight member 2*a* in the vicinity of the electron beam irradiating portion 1*a* of the rotating anticathode 1 is provided an X-ray window 21 for taking out an X-ray 20 generated by the irradiation of the electron beams 30 onto the electron beam irradiating portion 11*a*. At the X-ray window is provided an X-ray transmitting film 22 made of a material which can pass the X-ray therethrough such as Be so that the intended X-ray can be taken out of the apparatus with maintaining the vacuum condition of the anticathode chamber 2.

The cathode 3 includes an insulating structured member 32, a filament 33 and a wehnelt 34 and is configured so as to generate and irradiate the electron beams 30 onto the anticathode 1 by supplying a high voltage of several tens KV and a filament electric power which are introduced from a high voltage introducing portion 31.

In the X-ray generating apparatus as described above, the cooling water is introduced from the inlet 16, and the rotating anticathode 1 is rotated around the rotating axis at high speed and moved repeatedly along the rotating axis by the driving motor 5. At the same time, the electron beams 30 are irradiated onto the electron beam irradiating portion 11*a* of the anticathode 1 from the cathode, thereby generating the X-ray 20 with high intensity. In this case, the intensity of the electron beams 30 are set to a one which can melt the electron beam irradiating portion 11*a* partially. The electron beam irradiating portion 11*a* becomes a depressed portion through the irradiation of the electron beams, but the depth of the depressed portion can be reduced in comparison with the depth of the depressed portion without the repeatedly movement of the rotating anticathode along the rotating axis. Hereinafter, the reduction in depth of the depressed portion due to the repeated movement of the rotating anticathode will be explained.

Figure 3:
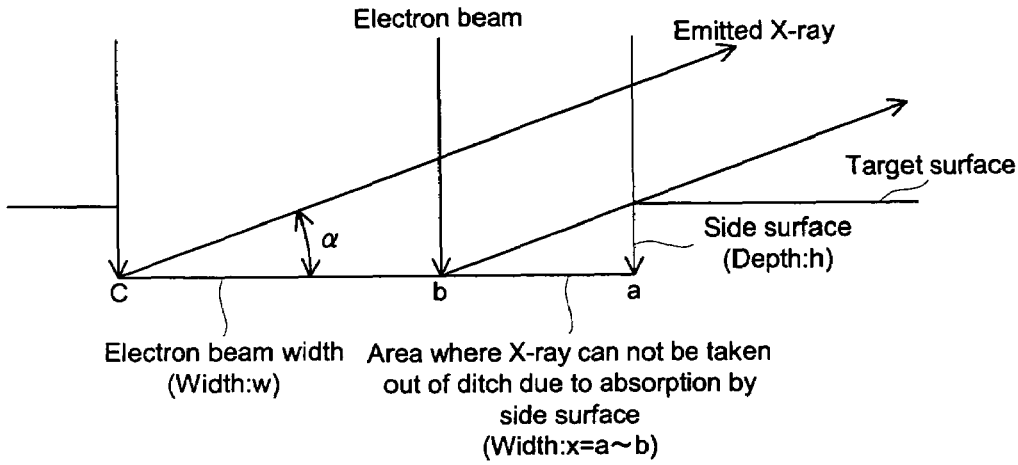
FIG. 3 is a view illustrating a state of the electron beam irradiating portion of the rotating anticathode without the repeated movement of the rotating anticathode along the rotating axis and with the rotating movement of the rotating anticathode around the rotating axis.
Figure 4:
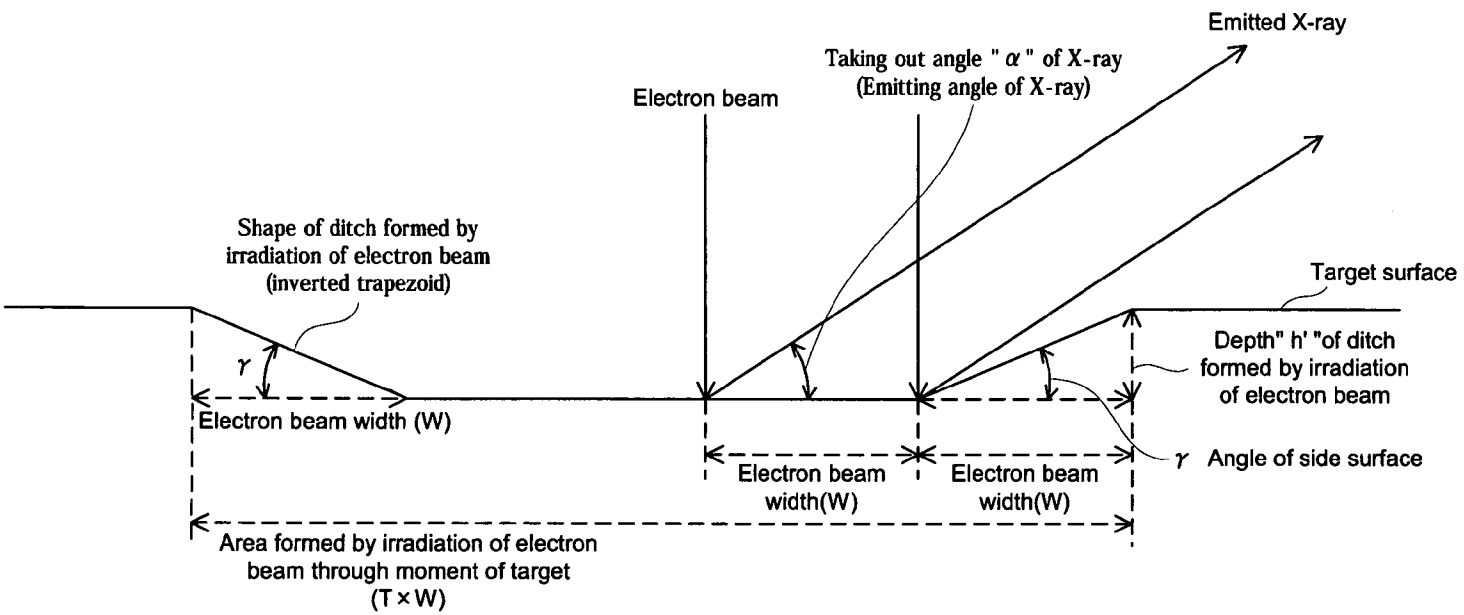
FIG. 4 is a view illustrating a state of the electron beam irradiating portion of the rotating anticathode with the repeated movement of the rotating anticathode along the rotating axis and with the rotating movement of the rotating anticathode around the rotating axis.

FIG. 3 is a view illustrating a state of the electron beam irradiating portion 11*a* of the rotating anticathode 1 without the repeated movement of the rotating anticathode 1 along the rotating axis and with the rotating movement of the rotating anticathode 1 around the rotating axis, and FIG. 4 is a view illustrating a state of the electron beam irradiating portion 11*a* of the rotating anticathode 1 with the repeated movement of the rotating anticathode 1 along the rotating axis and with the rotating movement of the rotating anticathode 1 around the rotating axis.

As illustrated in FIG. 3, when the electron beams are irradiated onto the inner wall 11*a*, the electron beam irradiating portion becomes a depressed portion where is defined by the bottom surface with a width of w and the side surface with a depth of h. In this case, suppose that the taking out angle and emitting efficiency of the intended X-ray is set to α and E, respectively, the X-ray is disturbed partially by the side surface of the depressed portion, and thus, the depth $h_E$ of the depressed portion can be represented by the following equation:

$$h_E=(1-0.01\,E)w\tan\alpha \quad (1)$$

Then, the emitting efficiency E(%) of the X-ray can be represented by the following equation:

$$100\times(1-h_E/w\tan\alpha) \quad (2)$$

Herein, the emitting efficiency E(%) of the X-ray is standardized on the emitting amount of the X-ray when no depressed portion is formed at the electron beam irradiating portion. The emitting efficiency E(%) of the X-ray can be also represented by the following equation: E=100(w−x)/w. Since the equation of x=h/tan α (tan α=h/x) can be also established, the equation (1) can be obtained from the above two equations by deleting the "x".

On the other hand, if the rotating anticathode 1 is moved repeatedly at a constant speed by the magnitude T times as large as the line width w of the electron beams, the electron beam irradiating portion becomes a depressed portion having a bottom surface with a width of w×(T−2), inclined portions with a width w which are located at both ends of the depressed portion and side walls with a depth h', so that the depressed portion is formed in an inverted trapezoidal shape. In this case, since the angle γ of the inclined portions is smaller than the talking out angle α, the X-ray generated from the bottom surface of the depressed portion through the irradiation of the electron beams can be taken out of the depressed portion at an efficiency of 100%.

Suppose that the taking out efficiency of the X-ray at the inclined portions is set to E' (%), the total taking out efficiency of the X-ray over the depressed portion can be represented by the following equation:

$$[100\times\{w\times(T-2)\}+E'\times 2wJ/wT \quad (3)$$

In fact, as illustrated in FIG. 4, when the rotating anticathode 1 is repeatedly moved by the magnitude twice as large as the line width w of the electron beams at T=3 and w=1 mm, the emitting efficiency of the X-ray can be enhanced up to 95% even though the depth of the depressed portion (electron beam irradiating portion) is increased to about 100 μm.

On the other hand, as illustrated in FIG. 3, in order to realize the emitting efficiency of 95% at w=1 mm without the repeated movement of the rotating anticathode, it is required that the depth of the depressed portion (electron beam irradiating portion) is decreased to about 10 μm. If the depth of the depressed portion is increased, the emitting efficiency of the X-ray is decreased from 95%.

In this way, in this embodiment, since the rotating anticathode is repeatedly moved by the magnitude twice or over as large as the width of the electron beams, the intended X-ray can be taken out of the depressed portion at an efficiency of 95% even though the depth of the depressed portion (electron beam irradiating portion) is enlarged ten times.

In this embodiment, a special processing is not carried out for the cylindrical portion 11 of the anticathode 1 so that the electron beam irradiating portion 11*a* is positioned on the inner wall of the cylindrical portion 11 under the condition that the side wall of the cylindrical portion 11 is set parallel to the rotation axis. However, the inner wall of the cylindrical portion 11 can be inclined by several tenths of one degree through several tens degrees.

Concretely, the inner wall of the cylindrical portion 11 can be inclined inwardly toward the rotating axis by several tenths of one degree through several tens degrees. In this case, the electron beam irradiating portion 11*a*, which is melted, can be located more stably on the inner wall of the cylindrical portion 11 against the centrifugal force. As a result, the outer splash of the electron beam irradiating portion 1*a* can be prevented more effectively. In contrast, the inner wall of the cylindrical portion 11 can be inclined outwardly from the rotation axis by several tenths of one degree through several tens degrees. In this case, the intended X-ray can be taken easily out of the apparatus under the condition that the outer splash of the electron beam irradiating portion 11*a* melted can be prevented.

If the electron beam irradiating portion 11*a* is formed such that the cross sectional shape becomes a V-shaped ditch or a U-shaped ditch, the outer splash of the electron beam irradiating portion 11*a* can be prevented more effectively. In this case, the width and depth of the V-shaped ditch or the U-shaped ditch are determined so that the intended X-ray can be taken easily out of the apparatus. Moreover, since the electron beam irradiating portion 11*a* becomes a trapezoidal shape as defined by the "T" and the "w", the surface deformation of the electron beam irradiating portion 11*a* through melting can be repressed if the electron beam irradiating portion is processed into the corresponding trapezoidal shape with mirror plane effect.

In addition, if the electron beam irradiating portion 11*a* is made of a target material in dependence on the kind of X-ray to be generated and the area around the electron beam irradiating portion 11*a* is made of a material with higher melting point and/or higher thermal conductivity than the target material, the cooling efficiency of the anticathode 1 can be enhanced entirely and the intended X-ray can be generated constantly over a prolonged period of time.

Furthermore, the anticathode 1, particularly the cylindrical portion 11 to which the electron beams 30 are irradiated may be made of the target material and the high melting point and/or high thermal conductivity substance may be provided at the backside of the target material so that the cylindrical portion 11 can be a double structure. In this case, while the intended X-ray is generated by the irradiation of the electron beams 30 onto the cylindrical portion 11, the cylindrical portion 11 is cooled by a cooling medium so that the electron beams 30 can not penetrate through the cylindrical portion 11 on the synergy effect of the large heat resistance and the large cooling effect which are originated from the high melting point and/or the high thermal conductivity of the substance provided at the backside of the target material. As a result, the cooling medium can not be leaked.

As the cooling medium can be exemplified a cooling water and a cooling oil.

In this embodiment, since the electron beam irradiating portion 11*a* is melted, the metallic vapor pressure may increase by the melting of the target material in the anticathode chamber 2, thereby contaminating the X-ray transmitting window 22. In this case, a rolled protective film, which is made of Ni, BN, Al or mylar against recoil electrons and exchangeable, may be provided in front of the X-ray transmitting window 22. The rolled protective film is tensed between the supplying roll and the winding roll which are provided inside the X-ray window 21. The thickness of the protective film is appropriately adjusted in view of the recoil electron energy and the X-ray absorption.

In this embodiment, although the electron beams are employed as the energy beams, other energy beams such as laser beams and ion beams may be employed.

Although the present invention was described in detail with reference to the above examples, this invention is not limited to the above disclosure and every kind of variation and modification may be made without departing from the scope of the present invention.

What is claimed is:

1. A method for generating an X-ray, comprising the steps of:

moving an anticathode repeatedly along a rotating axis of said anticathode while rotating said anticathode around said rotating axis; and irradiating energy beams onto a surface portion of said anticathode which is located against a centrifugal force generated from the rotation of said anticathode to partially melt said surface portion through heating said surface portion near a melting point of said anticathode or over the melting point of said anticathode, thereby generating an X-ray from said rotating anticathode, wherein a moving length of said rotating anticathode along said rotating axis is set larger than a line width of said energy beams.

2. The generating method as defined in claim 1, wherein the movement of said rotating anticathode along said rotating axis is carried out periodically.

3. The generating method as defined in claim 1, wherein the moving length of said rotating anticathode along said rotating axis is set at least twice as large as the line width of said energy beams.

4. The generating method as defined in claim 3, wherein a reduction in intensity of said X-ray to be emitted due to a depressed portion of said surface portion of said anticathode which is formed from an irradiation of said energy beams is 5% or below.

5. The generating method as defined in claim 4, wherein said depressed portion is formed in an inverted trapezoidal shape having a flat bottom surface at a center thereof and inclined portions at both ends thereof which rise from said bottom surface by a given angle so that the given angle is set smaller than a taking out angle of said X-ray from said depressed portion.

6. The generating method as defined in claim 1, wherein said anticathode includes a cylindrical portion provided along a periphery of said anticathode so that said energy beams are irradiated onto an inner wall of said cylindrical portion.

7. The generating method as defined in claim 6, wherein a side wall of said cylindrical portion is inclined inwardly toward a center axis of said anticathode so that an outer splash of said surface portion of said anticathode to which said energy beams are irradiated is repressed through a melting of said surface portion.

8. The generating method as defined in claim 6, wherein a side wall of said cylindrical portion is inclined outwardly from a center axis of said anticathode so that said X-ray can be taken easily out of said anticathode.

9. The generating method as defined in claim 1, wherein said surface portion to which said energy beams are irradiated is formed in a V-shaped ditch or a U-shaped ditch.

10. The generating method as defined in claim 9, wherein said V-shaped ditch or said U-shaped ditch is formed in the same shape as said centrifugal force affects said surface portion under melting to which said energy beams are irradiated.

11. The generating method as defined in claim 1, further comprising the step of, in said anticathode, making an area around said surface portion to which said energy beams are irradiated from a substance with a higher melting point and/or a higher thermal conductivity than a target material of said anticathode contributing the generation of said X-ray.

12. The generating method as defined in claim 1, wherein said energy beams are electron beams.

13. The generating method as defined in claim 12, wherein said electron beams are emitted from a cathode which is provided opposite to said rotating anticathode, and an anticathode chamber for accommodating said rotating anticathode and a cathode chamber for accommodating said cathode which are located in a vicinity of one another and made of an air-tight member so that a through-hole or a tube is formed at a separating wall between said anticathode chamber and said cathode chamber and interiors of said anticathode chamber and said cathode chamber are evacuated in vacuum with vacuum pumps.

14. The generating method as defined in claim 13, wherein said X-ray is taken out through an X-ray penetrating film which is provided at said air-tight member.

15. The generating method as defined in claim 14, further comprising the step of providing a protective film over said X-ray penetrating film so as to prevent a contamination of a vapor of a target material contributing to a generation of said X-ray for said X-ray penetrating film.

16. An apparatus for generating an X-ray, comprising:

a rotating anticathode configured so as to be rotated around a rotating axis thereof and to be moved repeatedly along said rotating axis; and an energy source for irradiating energy beams onto a surface portion of said anticathode which is located against a centrifugal force generated from the rotation of said anticathode to partially melt said surface portion through heating said surface portion near a melting point of said anticathode or over a melting point of said anticathode, thereby generating an X-ray from said rotating anticathode, wherein a moving length of said rotating anticathode along said rotating axis is set by the apparatus to be larger than a line width of said energy beams.

17. The generating apparatus as defined in claim 16, wherein the movement of said rotating anticathode along said rotating axis is carried out periodically.

18. The generating apparatus as defined in claim 15, wherein the moving length of said rotating anticathode along said rotating axis is set at least twice as large as the line width of said energy beams.

19. The generating apparatus as defined in claim 18, wherein a reduction in intensity of said X-ray to be emitted due to a depressed portion of said surface portion of said anticathode which is formed from an irradiation of said energy beams is 5% or below.

20. The generating apparatus as defined in claim 19, wherein said depressed portion is formed in an inverted trapezoidal shape having a flat bottom surface at a center thereof and inclined portions at both ends thereof which rise from said bottom surface by a given angle so that the given angle is set smaller than a taking out angle of said X-ray from said depressed portion.

21. The generating apparatus as defined in claim 16, wherein said rotating anticathode includes a cylindrical portion provided along a periphery of said rotating anticathode so that said energy beams are irradiated onto an inner wall of said cylindrical portion.

22. The generating apparatus as defined in claim 21, wherein a side wall of said cylindrical portion is inclined inwardly toward a center axis of said rotating anticathode so that an outer splash of said surface portion of said anticathode to which said energy beams are irradiated is repressed through a melting of said surface portion.

23. The generating apparatus as defined in claim 21, wherein a side wall of said cylindrical portion is inclined outwardly from a center axis of said rotating anticathode so that said X-ray can be taken easily out of said anticathode.

24. The generating apparatus as defined in claim 16, wherein said surface portion to which said energy beams are irradiated is formed in a V-shaped ditch or a U-shaped ditch.

25. The generating apparatus as defined in claim 24, wherein said V-shaped ditch or said U-shaped ditch is formed in a same shape as said centrifugal force affects said surface portion under melting to which said energy beams are irradiated.

26. The generating apparatus as defined in claim 16, further comprising the step of, in said anticathode, making an area around said surface portion to which said energy beams are irradiated from a substance with higher melting point and/or higher thermal conductivity than a target material of said anticathode contributing a generation of said X-ray.

27. The generating apparatus as defined in claim 16, wherein said energy beams are electron beams.

28. The generating apparatus as defined in claim 27, wherein said electron beams are emitted from a cathode which is provided opposite to said rotating anticathode, and an anticathode chamber for accommodating said rotating anticathode and a cathode chamber for accommodating said cathode which are located in a vicinity of one another and made of air-tight member so that a through-hole or a tube is formed at a separating wall between said anticathode chamber and said cathode chamber and interiors of said anticathode chamber and said cathode chamber are evacuated in vacuum with vacuum pumps.

29. The generating apparatus as defined in claim 25, wherein said X-ray is taken out through an X-ray penetrating film which is provided at said air-tight member.

30. The generating apparatus as defined in claim 29, further comprising a protective film over said X-ray penetrating film so as to prevent a contamination of a vapor of a target material contributing to the generation of said X-ray for said X-ray penetrating film.

* * * * *

UNITED STATES PATENT AND TRADEMARK OFFICE

CERTIFICATE OF CORRECTION

PATENT NO. : 7,394,891 B2
APPLICATION NO. : 11/509670
DATED : July 1, 2008
INVENTOR(S) : Noriyoshi Sakabe It is certified that error appears in the above-identified patent and that said Letters Patent is hereby corrected as shown below:

Title page
Please delete the following Item:
(73) Assignee: Noriyoshi Sakabe and Kiwake Sakabe, Tsukuba (JP)

and Replace with:
(73) Assignee: Noriyoshi Sakabe and Kiwako Sakabe, Tsukuba (JP)

Signed and Sealed this

Fourth Day of November, 2008

JON W. DUDAS
*Director of the United States Patent and Trademark Office*